US007040240B2

(12) United States Patent
Goke et al.

(10) Patent No.: US 7,040,240 B2
(45) Date of Patent: May 9, 2006

(54) ASH FUSING SYSTEM, METHOD OF OPERATING THE SYSTEM, AND GASIFICATION FUSING SYSTEM FOR WASTE

(75) Inventors: Chikao Goke, Tokyo (JP); Nobuya Azuma, Tokyo (JP); Masaaki Irie, Tokyo (JP); Kazuo Takano, Tokyo (JP); Tetsuhisa Hirose, Tokyo (JP); Kazuaki Watanabe, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 10/485,272

(22) PCT Filed: Apr. 10, 2003

(86) PCT No.: PCT/JP03/04569

§ 371 (c)(1),
(2), (4) Date: Jan. 30, 2004

(87) PCT Pub. No.: WO03/085322

PCT Pub. Date: Oct. 16, 2003

(65) Prior Publication Data

US 2004/0231243 A1 Nov. 25, 2004

(30) Foreign Application Priority Data

Apr. 10, 2002 (JP) ..... 2002-108221

(51) Int. Cl.
*F23J 3/00* (2006.01)

(52) U.S. Cl. ..... 110/266; 110/344; 110/348

(58) Field of Classification Search ..... 110/266, 110/297, 165 R, 348, 344, 343, 342, 233, 110/234
See application file for complete search history.

(56) References Cited

U.S. PATENT DOCUMENTS

| | | | | |
|---|---|---|---|---|
| 1,680,183 | A * | 8/1928 | Szikla et al. | 110/266 |
| 1,846,647 | A * | 2/1932 | Leitch et al. | 110/266 |
| 2,971,830 | A * | 2/1961 | Kawai et al. | 48/206 |
| 3,133,804 | A * | 5/1964 | Hardgrove | 65/141 |
| 3,589,317 | A * | 6/1971 | Kunovits | 110/342 |
| 3,729,298 | A * | 4/1973 | Anderson | 48/111 |
| 4,301,747 | A * | 11/1981 | Lockwood et al. | 110/171 |

FOREIGN PATENT DOCUMENTS

| | | |
|---|---|---|
| JP | 64-56183 | 3/1989 |
| JP | 9-59046 | 3/1997 |
| JP | 9-96407 | 4/1997 |
| JP | 11-241817 | 9/1999 |
| JP | 3077036 | 2/2001 |

* cited by examiner

*Primary Examiner*—Kenneth Rinehart
(74) *Attorney, Agent, or Firm*—Wenderoth, Lind & Ponack, L.L.P.

(57) ABSTRACT

An ash melting system of the present invention includes a slagging combustion furnace (10) for melting ash into molten slag; and a slag separating apparatus (50) for bringing the molten slag (121) discharged from the slagging combustion furnace into contact with slag cooling water (152) to produce water-quenched slag (122), and separating the water-quenched slag from the slag cooling water. The ash melting system further includes a gas blowing means for blowing air or inert gas (132) between a slag discharge port (14) of the slagging combustion furnace and the surface of the slag cooling water.

14 Claims, 6 Drawing Sheets

ASH FUSING SYSTEM, METHOD OF OPERATING THE SYSTEM, AND GASIFICATION FUSING SYSTEM FOR WASTE

TECHNICAL FIELD

The present invention relates to a melting system for bringing the molten slag discharged from an ash melting furnace into contact with water to produce water-quenched slag and a method of operating such melting system, and a melting system attached to a gasification and slagging combustion system for combusting various wastes including municipal wastes, refuse-derived fuel (RDF), plastic wastes, waste FRP, biomass wastes, automobile wastes, waste oil, and the like.

BACKGROUND ART

It has been desired that wastes including municipal wastes, refuse-derived fuel (RDF), plastic wastes, waste FRP, biomass wastes, automobile wastes, waste oil, and the like are safely combusted to reduce the volume of the wastes, and the combustion heat of the wastes is effectively utilized. Because incineration ash usually contains harmful heavy metals, in order to reclaim the incineration ash, it is necessary to take some measures for stabilizing heavy metal components. Further, there has been a request for downsizing a waste treatment facility as a whole. In order to realize the above subjects, a gasification and slagging combustion system which can recover various metals and harmless slag capable of being effectively utilized, and recover energy in the form of heat, electric power or the like has been put to practical use. The gasification and slagging combustion system is not ordinary incineration, but is capable of performing material and thermal recycling.

In the gasification and slagging combustion system, wastes are pyrolyzed and gasified at a temperature of 450 to 750° C. to generate a gas, tar, char (solid carbon containing ash), and the like in the gasification furnace, and the generated gas and tar are introduced into the slagging combustion furnace together with particulate char and combusted by a secondary air at a high temperature under a low air ratio of about 1.3 to about 1.5 to increase a combustion temperature of a melting point of ash or higher (for example, 1300° C. to 1450° C.) in the slagging combustion furnace. In this high-temperature condition, molten ash is collected on a furnace wall surface and falls along the furnace wall surface, thus forming a flow of molten slag. This molten slag is contacted with cooling water to form water-quenched slag.

An ash melting system does not have a gasification furnace. In the ash melting system, ash is supplied directly to a melting furnace to produce molten slag. The process in which molten slag is converted into water-quenched slag is substantially the same as the above gasification and slagging combustion system. Therefore, details of the ash melting system will not be described here.

Next, a combination of a gasification apparatus comprising a fluidized-bed gasification furnace and a slagging combustion furnace comprising a swirling-type slagging combustion furnace will be described below. FIG. 1 shows a conventional melting system having a swirling-type slagging combustion furnace and a water quenching trough, and a slag separating apparatus for separating molten slag.

In FIG. 1, reference numeral 10 represents a swirling slagging combustion furnace (swirling-type slagging combustion furnace), reference numeral 30 represents a water quenching trough, and reference numeral 50 represents a slag separating apparatus. The swirling-type slagging combustion furnace 10 comprises a primary combustion chamber 11, a secondary combustion chamber 12, and a tertiary combustion chamber 13. A produced gas (combustible gas) 111 containing char and tar which has been generated by pyrolysis and gasification in a gasification furnace (not shown) is introduced into the upper part of the primary combustion chamber 11 tangentially to an inner wall surface of the primary combustion chamber 11. Then, the gas 111 is mixed with a gas for combustion (usually, preheated air) 115 introduced into the primary combustion chamber 11, and is combusted and flows into the secondary combustion chamber 12 where the gas is combusted at a high temperature of about 1300 to about 1450° C. Then, the gas flows into the tertiary combustion chamber 13 and is completely combusted, and resultant combustion exhaust gas 113 is then supplied to a waste heat boiler (not shown). In FIG. 1, reference numerals 15 and 16 represent a burner for startup and auxiliary heat supply of the slagging combustion furnace, respectively.

The generated gas 111 containing char and tar which has been introduced into the upper part of the primary combustion chamber 11 forms a swirling flow, and moves to the secondary combustion chamber 12 while it is combusted at a high temperature in the swirling flow. Under centrifugal forces by the swirling flow, ash contained in the char is changed to slag mists and collected on the furnace wall surface. The slag mists attached to the furnace wall surface form a layer of molten slag 121, and the molten slag 121 flows down the bottom of the secondary combustion chamber 12, then falls from a slag discharge port 14 onto the water quenching trough 30. Water for cooling molten slag (hereinafter referred to as slag cooling water 152) flows on the water quenching trough 30 at all times. The molten slag 121 which has fallen from the slag discharge port 14 is dropped into the slag cooling water 152 and quenched to form water-quenched slag 122. The water-quenched slag 122 flows together with the slag cooling water 152 into a water tank 51 of the slag separating apparatus 50. The water tank 51 has a slag settling function. The settled water-quenched slag is scraped and removed by scrapers 53 attached to a separating conveyor 52, and is carried upwardly and separated from the slag cooling water. The water-quenched slag 122 is then discharged from the separating conveyor 52 through a slag discharge opening 54 to the outside of the slag separating apparatus 50. The slag cooling water 152 in the water tank 51 is delivered by a pump 41 from the water tank 51 onto the water quenching trough 30 through a pipe-line 151 and a nozzle 32. The slag cooling water 152 is circulated and reused.

The slag discharge port 14 serves to discharge molten slag 121 from the swirling-type slagging combustion furnace 10. However, because the swirling-type slagging combustion furnace 10 is filled with the exhaust gas 112, the molten slag 121 accompanies the exhaust gas 112 which is unavoidably going to contact the slag cooling water 152. Since the exhaust gas 112 contains many components including harmful substances, the exhaust gas 112 tends to contaminate the slag cooling water 152 and deteriorates the quality of the slag cooling water 152 by being contacted with the slag cooling water 152. As a result, the recovered water-quenched slag 122 is contaminated by the slag cooling water 152.

When the high-temperature molten slag 121 contacts the slag cooling water 152, a part of the slag cooling water 152 is evaporated, and the generated steam goes up to cool the slag discharge port 14. Consequently, the molten slag 121 is liable to be solidified on the inner surface of the slag discharge port 14 and the portion around the slag discharge port 14, and in extreme cases, the slag discharge port 14 is clogged with the solidified slag.

SUMMARY OF THE INVENTION

The present invention has been made in view of the above drawbacks. It is therefore an object of the present invention to provide an ash melting system, a method of operating a melting furnace apparatus, and a gasification and slagging combustion system, for producing water-quenched slag by bringing molten slag discharged from a slagging combustion furnace into contact with slag cooling water, which can prevent exhaust gas discharged together with the molten slag from the slagging combustion furnace (melting furnace) from contacting the slag cooling water, prevent a slag discharge port and a portion around the slag discharge port from being cooled by steam evaporated from the slag cooling water, and prevent the water-quenched slag from being made worse in quality due to a deterioration in the quality of the slag cooling water (if the slag cooling water is contaminated, the contaminated slag cooling water is adhered to the surface of the slag granules to cause a deterioration in the quality of water-quenched slag).

Another object of the present invention is to provide a cleaning system for removing harmful contaminants such as heavy metals which may have been adhered to the surfaces of water-quenched slag granules, even if exhaust gas discharged together with molten slag from a slagging combustion furnace is not fully prevented from contacting slag cooling water.

In order to achieve the above objects, according to the present invention, there is provided an ash melting system comprising: a slagging combustion furnace for melting ash into molten slag and discharging the molten slag from a slag discharge port; a slag separating apparatus for bringing the molten slag into contact with slag cooling water to produce water-quenched slag, and separating the water-quenched slag from the slag cooling water; and a gas blowing means for blowing air or inert gas between the slag discharge port of the slagging combustion furnace and the surface of the slag cooling water.

As described above, the gas blowing means is provided to blow air or inert gas between the slag discharge port of the slagging combustion furnace and the surface of the slag cooling water, thus preventing gas-liquid contact of exhaust gas and the slag cooling water. Therefore, the slag cooling water is prevented from being deteriorated in quality.

According to one aspect of the present invention, the system further comprises a gas mixture line for drawing a gas mixture of exhaust gas discharged from the slag discharge port of the slagging combustion furnace and the air or inert gas blown from the gas blowing means and supplying the gas mixture into the slagging combustion furnace.

As mentioned above, the gas mixture line is provided to draw a gas mixture from the slag discharge port and to supply the gas mixture into the slagging combustion furnace. The gas mixture line draws the air or inert gas blown between the slag discharge port and the surface of the slag cooling water and also steam evaporated from the slag cooling water, thus preventing the slag discharge port and its vicinity from being cooled. The line also draws the exhaust gas having a high temperature through the slag discharge port from the slagging combustion furnace, thus keeping the slag discharge port and the portion around the slag discharge port at a high temperature. If the gas that has been blown in is the air, because the air is supplied through the gas mixture line into the slagging combustion furnace, the air can be utilized as combustion air.

According to one aspect of the present invention, the system further comprises a flow control means provided in the gas mixture line for controlling the flow rate of the gas mixture drawn by the gas mixture line.

As mentioned above, the flow control means can regulate the flow rate of the gas mixture drawn from the slag discharge portion.

According to one aspect of the present invention, the system further comprises a temperature sensor provided in the gas mixture line for measuring the temperature of the gas mixture in the gas mixture line; wherein the flow control means is operated on a basis of an output of the temperature sensor to control the flow rate of the gas mixture drawn by the gas mixture line to equalize the temperature of the gas mixture line with a set temperature.

The set temperature has a lower limit which is higher than the dew point of hydrogen chloride contained in the exhaust gas for preventing low-temperature corrosion. The set temperature has an upper limit which is determined depending on the allowable temperatures of pipes and a fan. Usually, the set temperature is set in a temperature range in which inexpensive carbon steel can be used. Specifically, the gas mixture line is preferably controlled in the range of 110 to 350° C.

As described above, the temperature sensor is provided to measure a temperature of the gas mixture, and the flow control means controls the rate of the gas mixture drawn by the gas mixture line, thus keeping the temperature of the gas mixture line at the set temperature on a basis of the output from the temperature sensor. If the set temperature is set to a value equal to or lower than the allowable temperature of the fan provided in the gas mixture line, then the temperature of the gas mixture line can be kept equal to or lower than the allowable temperature of the fan, and low-temperature corrosion of ducts of the gas mixture line and the fan is prevented.

According to an ash melting system of the present invention, slag discharged from a slagging combustion furnace is supplied together with slag cooling water to a water tank having a settling and separating function, the slag which has been settled and separated is removed from a bottom of the water tank and conveyed above the surface of the slag cooling water in the water tank, and then the slag is cleaned by cleaning water supplied from the cleaning water supply system.

With the above arrangement, harmful impurities such as heavy metals attached to the surfaces of the water-quenched slag can be removed from the water-quenched slag, and hence the water-quenched slag of good quality can be recovered.

Furthermore, even if the exhaust gas discharged together with the molten slag from the slagging combustion furnace is not completely prevented from contacting the slag cooling water, the same cleaning effect can be obtained.

According to one aspect of the present invention, there is provided a method of operating an ash melting system for melting ash into molten slag and discharging the molten slag from a slag discharge port in a slagging combustion furnace, and producing water-quenched slag by bringing the molten slag into contact with slag cooling water, the method comprising: blowing air or inert gas between the slag discharge port of the slagging combustion furnace and the surface of the slag cooling water to prevent gas-liquid contact of exhaust gas discharged from the slagging combustion furnace and the slag cooling water.

As described above, when the air or inert gas is blown between the slag discharge port of the slagging combustion furnace and the surface of the slag cooling water, the exhaust gas is prevented from contacting the slag cooling water, and hence the slag cooling water is prevented from being lowered in quality. The water-quenched slag is thus prevented from being lowered in quality due to a deterioration in the quality of the slag cooling water.

According to another aspect of the present invention, there is provided a method of operating an ash melting system for melting ash, comprising: producing water-quenched slag from molten slag discharged from a slagging combustion furnace by bringing the molten slag into contact with slag cooling water; supplying the water-quenched slag together with slag cooling water to a water tank having a settling and separating function; removing the settled water-quenched slag from a bottom of the water tank to separate the water-quenched slag from the slag cooling water; and supplying cleaning water supplied from a cleaning water supply system onto the water-quenched slag to clean the water-quenched slag after the water-quenched slag is removed from the bottom of the water tank and is conveyed above the surface of the slag cooling water in the water tank.

As described above, after the water-quenched slag is removed from the bottom of the water tank, the water-quenched slag is cleaned by the cleaning water supplied from the cleaning water supply system. Consequently, harmful impurities such as heavy metals attached to the surfaces of the water-quenched slag can be removed from the water-quenched slag, and hence the water-quenched slag of good quality can be recovered.

According to one aspect of the present invention, there is provided a gasification and slagging combustion system of wastes comprising: a gasification furnace for gasifying wastes to generate gasification products; a slagging combustion furnace for combusting the gasification products to produce molten slag; a water-quenched slag producing mechanism for producing water-quenched slag by bringing slag discharged from the slagging combustion furnace into contact with slag cooling water; and a gas blowing means for blowing air or inert gas between a slag discharge port of the slagging combustion furnace and the surface of the slag cooling water.

As described above, the gas blowing means is provided to blow the air or inert gas between the slag discharge port of the slagging combustion furnace and the surface of the slag cooling water, thus preventing exhaust gas discharged from the slagging combustion furnace through the slag discharge port from contacting the slag cooling water. Therefore, the gasification and slagging combustion system can be constructed such that the slag cooling water is prevented from being lowered in quality.

According to another aspect of the present invention, there is provided a gasification and slagging combustion system of wastes comprising: a gasification furnace for gasifying wastes to generate gasification products; and a slagging combustion furnace for combusting the gasification products to produce molten slag, wherein water-quenched slag is produced by bringing the molten slag discharged from the slagging combustion furnace into contact with slag cooling water, the water-quenched slag is supplied together with the slag cooling water to a water tank having a settling and separating function, and the settled water-quenched slag is removed from a bottom of the water tank to separate the water-quenched slag from the slag cooling water; wherein cleaning water supplied from a cleaning water supply system is supplied onto the slag to clean the slag after the slag is removed from the bottom of the water tank and is conveyed above the surface of the slag cooling water.

According to the gasification and slagging combustion system of wastes, the water-quenched slag is removed from the bottom of the water tank, and then the cleaning water supplied from the cleaning water supply system is supplied to the water-quenched slag to remove harmful impurities such as heavy metals attached to the surfaces of the water-quenched slag, and hence the water-quenched slag of good quality can be recovered.

DETAILED DESCRIPTION OF THE INVENTION

Figure 1:
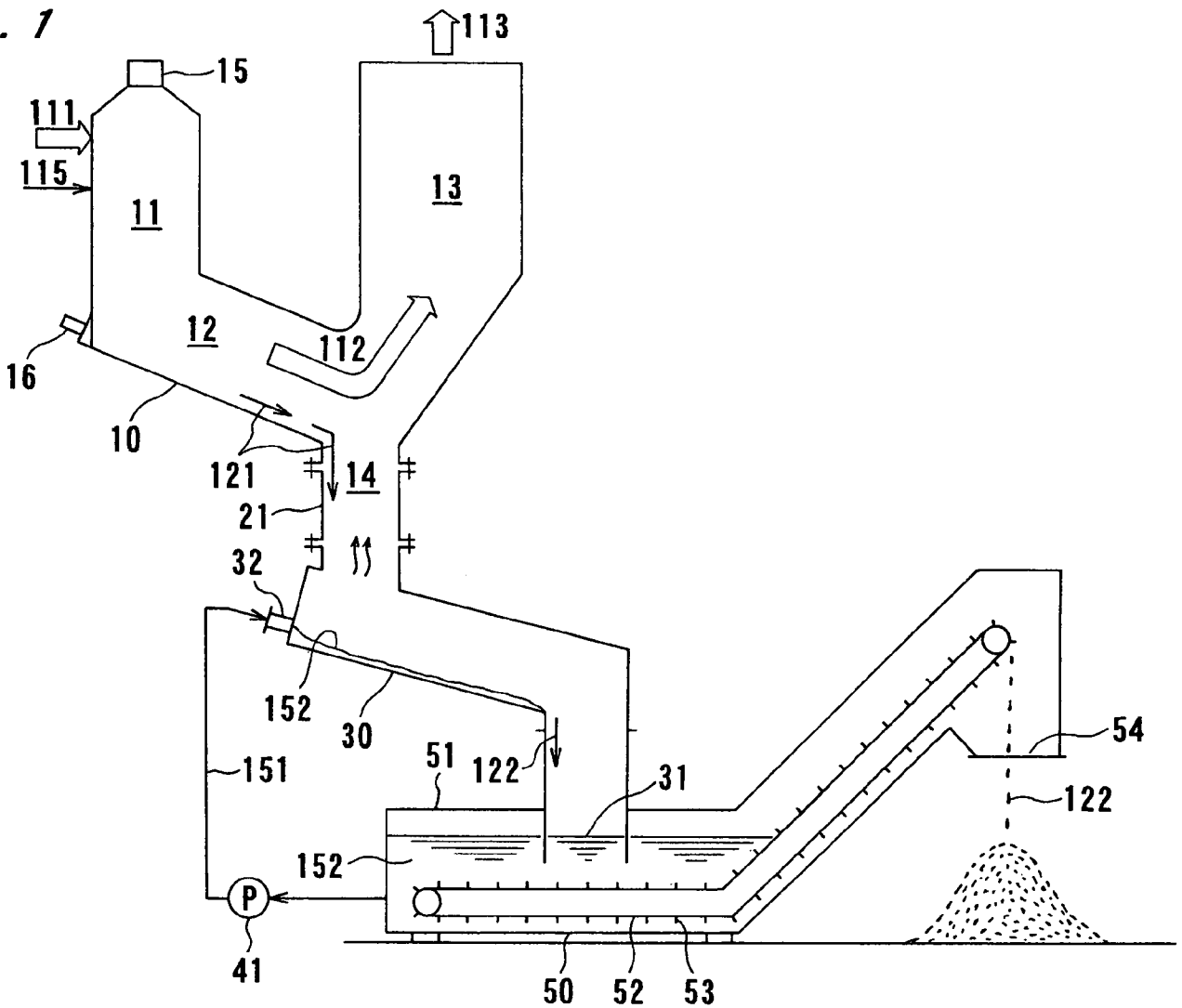
FIG. 1 is a schematic view of a conventional melting furnace apparatus having a swirling-type slagging combustion furnace (melting furnace), a water quenching trough, and a slag separating conveyor apparatus.
Figure 2:
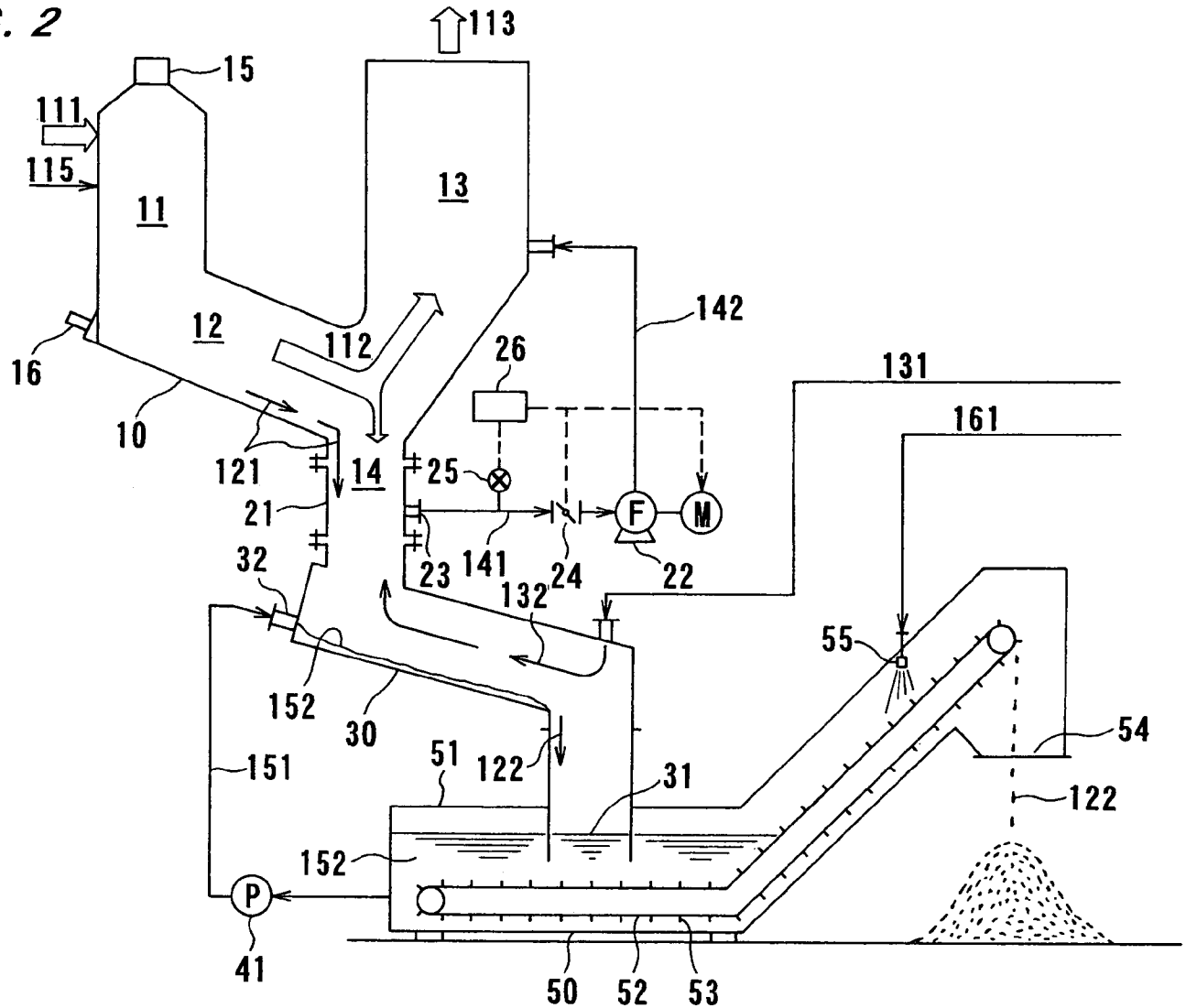
FIG. 2 is a schematic view of a melting system having a swirling-type slagging combustion furnace, a water quenching trough, and a slag separating conveyor apparatus according to the present invention.

Next, embodiments of the present invention will be described with reference to the drawings. FIG. 2 is a schematic view showing a gasification and slagging combustion system having a swirling-type slagging combustion furnace, a water quenching trough, and a slag separating apparatus according to the present invention. The gasification and slagging combustion system has a swirling-type slagging combustion furnace 10, a water quenching trough 30, and a slag separating apparatus 50. The swirling-type slagging combustion furnace 10 comprises a primary combustion chamber 11, a secondary combustion chamber 12, and a tertiary combustion chamber 13. A produced gas 111 produced by pyrolysis of wastes and containing char and tar is introduced into the upper part of the primary combustion chamber 11, is mixed with a gas 115 for combustion, and moves into the secondary combustion chamber 12 while it is combusted. In the secondary combustion chamber 12, the gas is combusted at a high temperature of 1300 to 1450° C. Then, the gas passes through the tertiary combustion chamber 13 and becomes exhaust gas 113, and the exhaust gas 113 is then discharged to a waste heat boiler (not shown).

The produced gas 111 (combustible gas containing unburned carbon and ash) produced by pyrolysis of wastes and containing char and tar is introduced into the upper part of the primary combustion chamber 11 in a direction tangential to an axis of the primary combustion chamber 11, thereby forming a swirling flow in the primary combustion chamber 11. The swirling flow causes the ash to be collected on the wall surface of the primary combustion chamber 11. The collected ash is melted at a high temperature to form molten slag 121, and the molten slag 121 falls from a slag discharge port 14 through a slag discharge chute 21 into the water quenching trough 30. The primary and secondary combustion chambers 11 and 12 have blowing ports directed to introduce a gas for combustion into the primary and secondary combustion chambers 11 and 12 in a direction tangential to axes of the primary and secondary combustion chambers 11 and 12. The molten slag 121 which has fallen into the water quenching trough 30 is brought into contact with slag cooling water 152 in the water quenching trough 30 to form water-quenched slag 122. The formed water-quenched slag 122 is delivered into the slag separating apparatus 50. In the slag separating apparatus 50, the water-quenched slag 122 is scraped by scrapers 53 of a separating conveyor 52 and is removed.

The gasification and slagging combustion system also has a gas blowing line 131 for blowing air (purge air) or inert gas (purge inert gas) at a discharge end of the water quenching trough 30. The gas blowing line 131 blows the air or inert gas 132 to the lower end of the flow of the slag cooling water 152 (the lower end of the slag-granulating water surface). The introduced air or inert gas 132 flows along the slag-cooling water surface into a region between the slag discharge port 14 of the swirling-type slagging combustion furnace 10 and the slag-cooling water surface. The air or inert gas 132 thus introduced is effective to prevent the exhaust gas 112 flowing in through the slag discharge port 14 from contacting the slag cooling water 152.

In this manner, by preventing gas-liquid contact of the slag cooling water 152 and the exhaust gas 112, the slag cooling water 152 is prevented from being lowered in quality.

Because the slag cooling water 152 is prevented from being lowered in quality, the water-quenched slag 122 is also prevented from being lowered in quality, i.e., from being lowered in quality by contaminants of the contaminated slag cooling water which would otherwise be attached to the surfaces of the water-quenched slag.

The air or inert gas 132 blown toward the lower end of the slag-granulating water surface of the water quenching trough 30 is effective to purge the exhaust gas 112. A plurality of blowing ports may be provided in the water quenching trough 30 for effectively purging the exhaust gas 112 or preventing the air or inert gas 132 from forming localized flows.

In the gasification and slagging combustion system, the water-quenched slag 122 produced in the water quenching trough 30 is introduced into a water tank 51 of the slag separating apparatus 50. The water tank 51 has a slag settling capability. The settled water-quenched slag is scraped by the scrapers 53 and removed from the bottom of the water tank 51, and separated from the slag cooling water. After the separated water-quenched slag is scraped and removed from the bottom of the water tank and conveyed above the water surface, the water-quenched slag is cleaned by cleaning water which is supplied from a cleaning water line 161 and sprayed by a spraying nozzle 55. Thereafter, the water-quenched slag 122 is conveyed by the separating conveyor 52, and discharged from a slag discharge opening 54.

In this manner, after the water-quenched slag is conveyed out of the bottom of the water tank 51, the water-quenched slag is cleaned by the sprayed cleaning water supplied from the cleaning water supply system. Consequently, harmful impurities such as heavy metals attached to the surfaces of the water-quenched slag can be removed from the water-quenched slag, and hence the water-quenched slag 122 of good quality can be recovered.

By spraying the cleaning water from the cleaning water line 161, the cleaning water infiltrates frictional components (sliding components) of the slag separating apparatus 50 and serves as a lubricant for those frictional components of the slag separating apparatus 50. Therefore, the cleaning water is effective to reduce noise and wear of the slag separating apparatus 50.

The method for cleaning water-quenched slag 122 in the slag separating apparatus 50 is not limited to the method for supplying the cleaning water from the spraying nozzle 55. Any method capable of cleaning the water-quenched slag 122 which has been conveyed out of the slag cooling water 152 in the water tank 51 may be used.

Even if a means for preventing the gas-liquid contact of the exhaust gas 112 and the slag cooling water 152 by blowing air (purge air) or inert gas (purge inert gas) from the gas blowing line 131 to the discharge end of the water quenching trough 30 is provided, the slag cooling water 152 is not fully effective to prevent the slag cooling water 152 from being contaminated on a long-term basis. However, as in the embodiment of FIG. 2, using the spraying nozzle 55 together with the gas blowing line 131 is effective to recover the water-quenched slag of good quality.

Further, as shown in FIG. 2, the slag discharge chute 21 has a suction port 23 for drawing in a mixture of the air or inert gas 132 introduced into the water quenching trough 30 and the exhaust gas 112. The suction port 23 is connected to a gas mixture line 141 which has a damper 24 for controlling the flow rate of the gas mixture drawn from the suction port 23 and a suction fan 22. The suction fan 22 has an outlet connected to a gas mixture blowing line 142 for blowing the gas mixture into the tertiary combustion chamber 13 of the slagging combustion furnace 10.

Further, a temperature sensor 25 is provided in the gas mixture line 141, and the output of the temperature sensor 25 is supplied to a temperature controller 26 which controls the opening of the damper 24 and/or the rotational speed of a drive motor M of the suction fan 22 so that a flow rate of the gas mixture is controlled to keep the gas mixture line 141 at a predetermined set temperature.

As described above, the temperature sensor 25 is provided in the gas mixture line 141 to control the circulating flow rate of the air or inert gas 132 and the exhaust gas 112 in order to keep the temperature of the gas mixture line 141 at a set temperature. Thus, the temperature of the gas mixture line 141 can be lowered to a allowable temperature of the suction fan 22. By keeping the gas mixture line 141 at a temperature equal to or higher than the dew point of hydrogen chloride contained in the exhaust gas, an occurrence of low-temperature corrosion of ducts which define the gas mixture line 141 and the gas mixture blowing line 142, and the suction fan 22 is prevented.

If a gas blown from the gas blowing line 131 is air, then the air is supplied as combustion air through the gas mixture blowing line 142 to the tertiary combustion chamber 13 of the slagging combustion furnace 10.

In the above embodiment, the temperature controller 26 controls the opening of the damper 24 and/or the rotational speed of the drive motor M for driving the section fan 22 to control the rate of the gas mixture. However, the temperature controller 26 may be used to control the rate of the air or inert gas 132 introduced from the gas blowing line 131 or control the rate of the exhaust gas through the gas mixture line 141 while keeping the rate of the air or inert gas 132 constant. That is, either the rate of the air or inert gas 132 introduced from the gas blowing line 131 or the rate of the exhaust gas 112 through the gas mixture line 141 may be controlled.

Further, in the slagging combustion furnace 10 shown in FIG. 2, a temperature sensor may be installed near the slag discharge port 14 of the slagging combustion furnace 10, and based on an output signal of the temperature sensor, the temperature controller 26 may control the opening of the damper 24 and/or the rotational speed of the drive motor M for driving the suction fan 22 to control the rate of the gas mixture of the air or inert gas 132 and the exhaust gas 112, thereby keeping the temperature of the slag discharge port 14 at a set temperature.

In this manner, by providing the temperature sensor near the slag discharge port 14 and controlling the flow rate of the gas mixture in order to keep the temperature of the slag discharge port 14 and the portion around the slag discharge port 14 at a set temperature or to keep the amount of slag attached to the slag discharge port 14 at a predetermined amount or less, based on an output signal from the temperature sensor serving as a flow control means, the slag discharge port 14 can have a desired level of dischargeability of molten slag. For example, by varying the rate of the gas mixture while keeping the temperature of the mixture of the exhaust gas and the air or inert gas constant, while heat resistance of the suction fan is ensured and low-temperature corrosion of the suction fan is prevented from occurring, a desired level of dischargeability of molten slag can be maintained.

Figure 3:
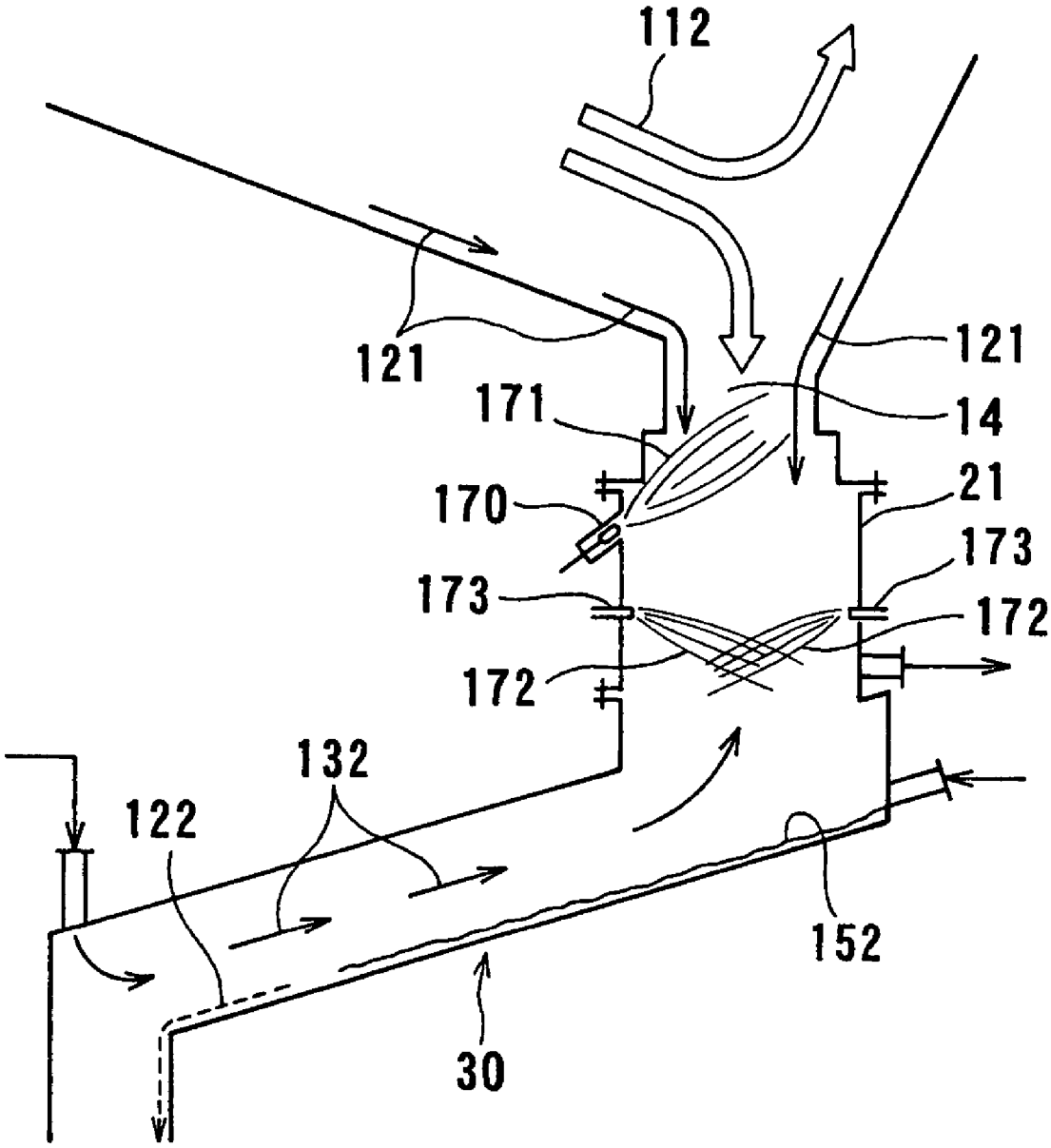
FIG. 3 is a schematic view showing a slag discharge port and a portion around the slag discharge port in a slagging combustion furnace according to the present invention.

When the slag discharge port is clogged for some reason, a burner 170 is operated to produce flames 171 to melt away the slag attached to the slag discharge port 14 and the portion around the slag discharge port 14, as shown in FIG. 3. Because the amount of a high-temperature gas produced is greater at this time than at a normal operation of the swirling-type slagging combustion furnace, only the air or inert gas 132 that is introduced is not sufficient enough to keep the gas mixture at a desired temperature, and the gas mixture tends to increase its temperature unduly. In order to solve this problem, there is provided a cooling water injecting mechanism having cooling water nozzles 173 for injecting cooling water 172 into the slag discharge chute 21. When the mixture gas suffers an undue temperature increase, cooling water is injected into the slag discharge chute 21 to lower the temperature of the gas mixture. In the case where the amount of a high-temperature gas produced is greater at this time than at a normal operation, the air or inert gas 132 may be introduced in an increased amount to cool the high-temperature gas. However, the air or inert gas 132 introduced in an increased amount would bring about an increase in the amount of the gas mixture, resulting in an uneconomical gas circulation system design. Furthermore, the air or inert gas 132 may be reduced in an amount depending on the scale of the furnace. The cooling water injecting mechanism which is used at all times in combination with the swirling-type slagging combustion furnace 10 is effective to reduce the temperature of the exhaust gas 112 and allows the gasification and slagging combustion system to have a wider range of applications.

The slag discharge port 14 may be cooled by water cooling tubes (water cooling structure) for increasing the durability of refractory material for defining the slag discharge port 14. The slag discharge port 14 thus cooled may be prevented from suffering an undue temperature rise. In view of the possibility of an undue temperature reduction of molten slag, the swirling-type slagging combustion furnace 10 should preferably be combined with an in-furnace ITV (Industrial Television) system, i.e., a remote monitoring system for monitoring the state of molten slag. The in-furnace ITV system has an ITV which may be located at a position for monitoring the slag discharge port.

Figure 4:
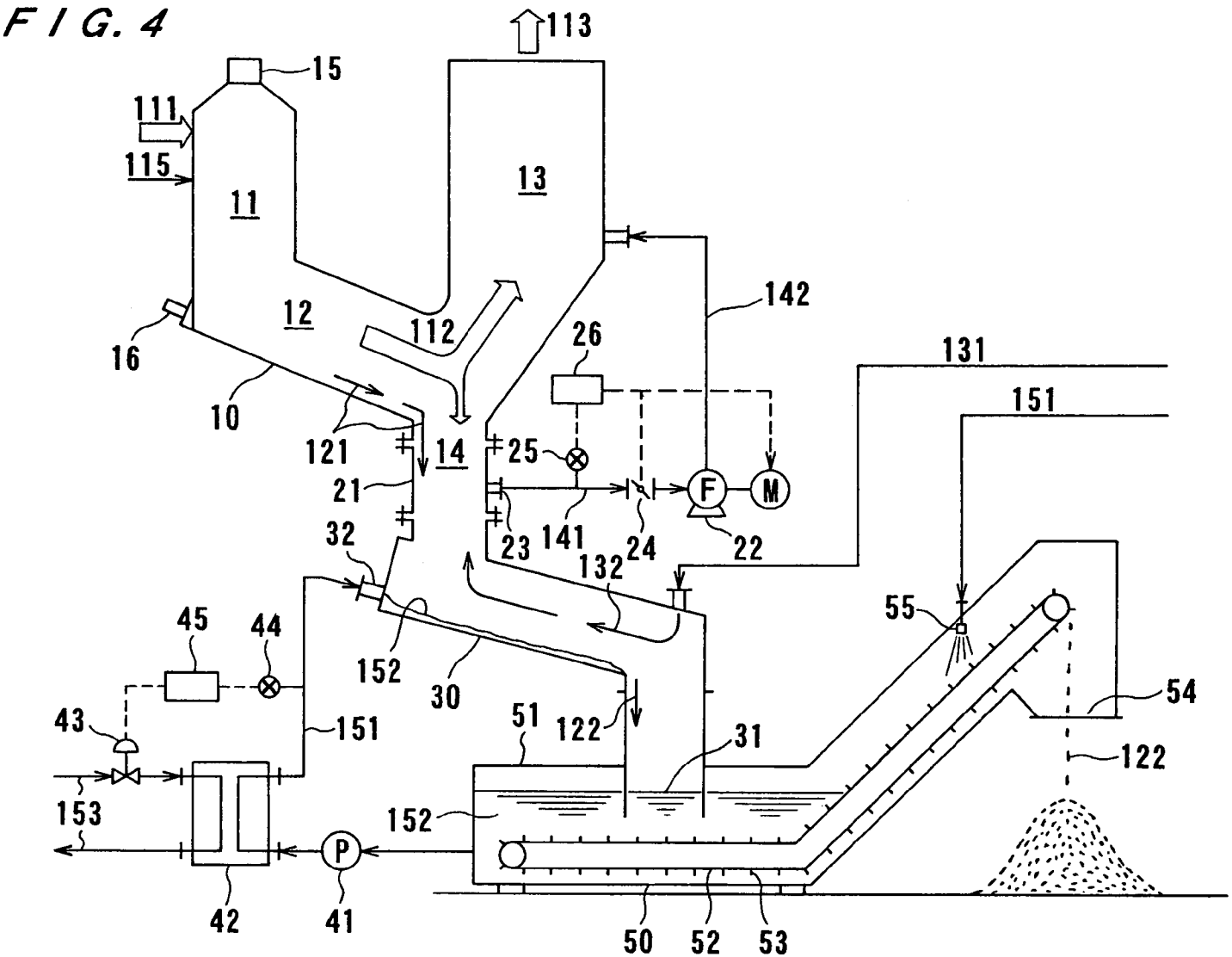
FIG. 4 is a schematic view of a melting system having a swirling-type slagging combustion furnace, a water quenching trough, and a slag separating conveyor apparatus according to the present invention.

FIG. 4 is a view showing a melting system according to another embodiment of the present invention.

The melting system shown in FIG. 4 differs from the melting system shown in FIG. 2 in that a heat exchanger 42 is provided in a slag cooling water circulation line 151, the slag cooling water 152 in the water tank 51 is delivered to the heat exchanger 42 by a pump 41. By introducing cooling water 153 from the outside, heat exchange between the cooling water 153 and the slag cooling water 152 is performed to cool the slag cooling water 152.

The cooling water 153 is introduced through a conduit having a control valve 43 which is controlled by a controller 45 that monitors the temperature of the slag cooling water 152 based on an output signal from a temperature sensor 44. The controller 45 controls the opening of the control valve 43 to control the rate of the cooling water 153 to keep the slag cooling water 152 at a set temperature.

The temperature of the slag cooling water 152 is increased when the slag cooling water 152 is brought into contact with the high-temperature molten slag 121. As the temperature of the slag cooling water 152 is increased, the amount of the slag cooling water 152 which is evaporated is also increased, and hence a large amount of replenishing water is required.

The increase of the amount of the evaporated slag cooling water 152 causes the temperature of the gas mixture in the slag discharge chute 21 to be lowered. In order to keep the gas mixture in the gas mixture line 141 constant, it is necessary to draw in a large amount of exhaust gas 112. Consequently, the gas mixture line 141, the gas mixture blowing line 142, and the suction fan 22 become large in size, resulting in an increase in the construction cost.

Further, the slag separating apparatus 50 also suffers a temperature increase, and this temperature increase is not desirable from the standpoint of safety and working environments.

According to the present invention, the heat exchanger 42 is provided in the slag cooling water circulation line 151, and heat exchange between the slag cooling water 152 in the water tank 51 of the slag separating apparatus 50 and the cooling water 153 supplied from the outside is performed to keep the slag cooling water 152 in the water tank 51 of the slag separating apparatus 50 in a set (or preset) temperature range for thereby suppressing evaporation of the slag cooling water 152.

Figure 5:
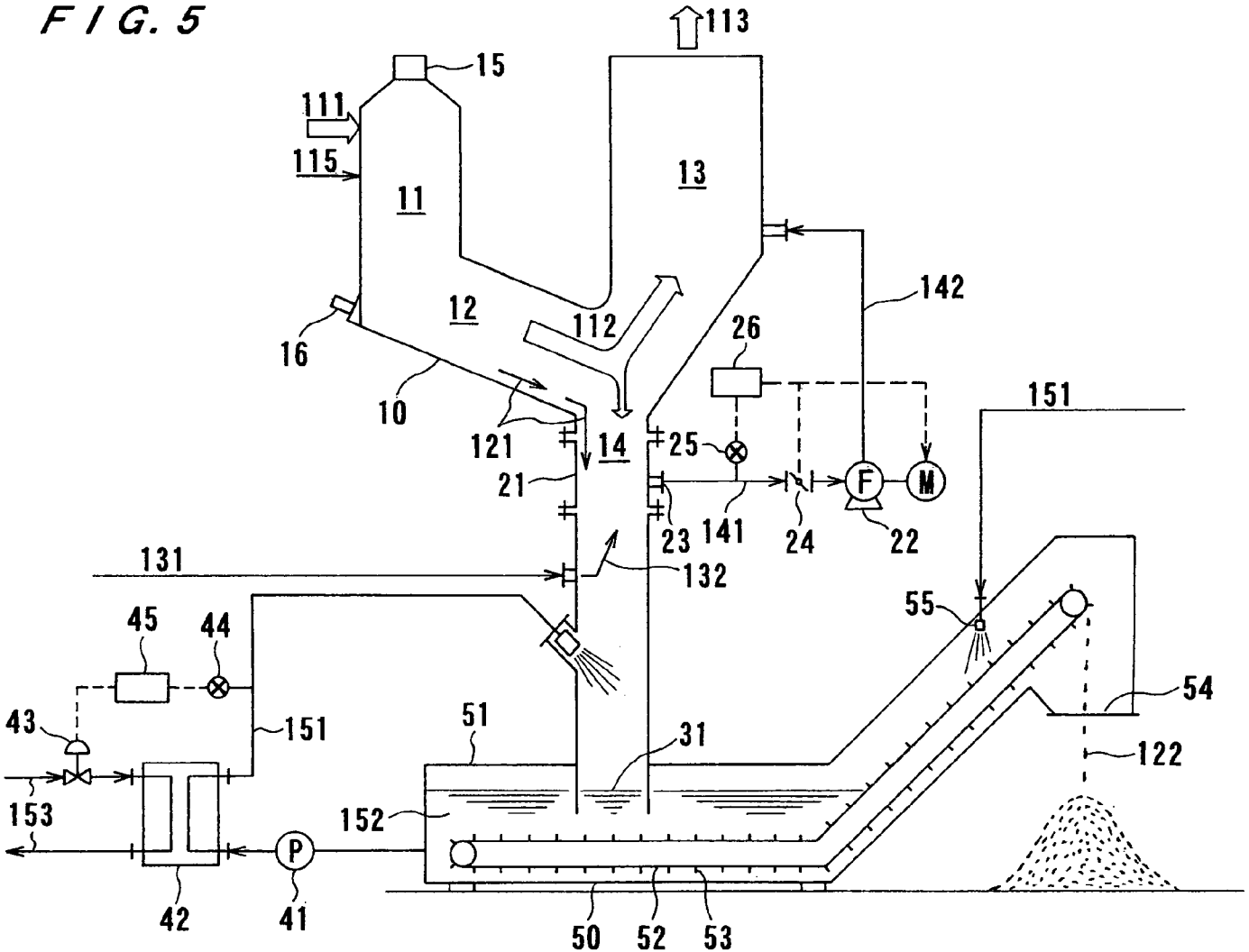
FIG. 5 is a schematic view of a melting system having a swirling-type slagging combustion furnace and a slag separating conveyor apparatus according to the present invention.

FIG. 5 schematically shows a melting system according to another embodiment of the present invention.

Figure 6:
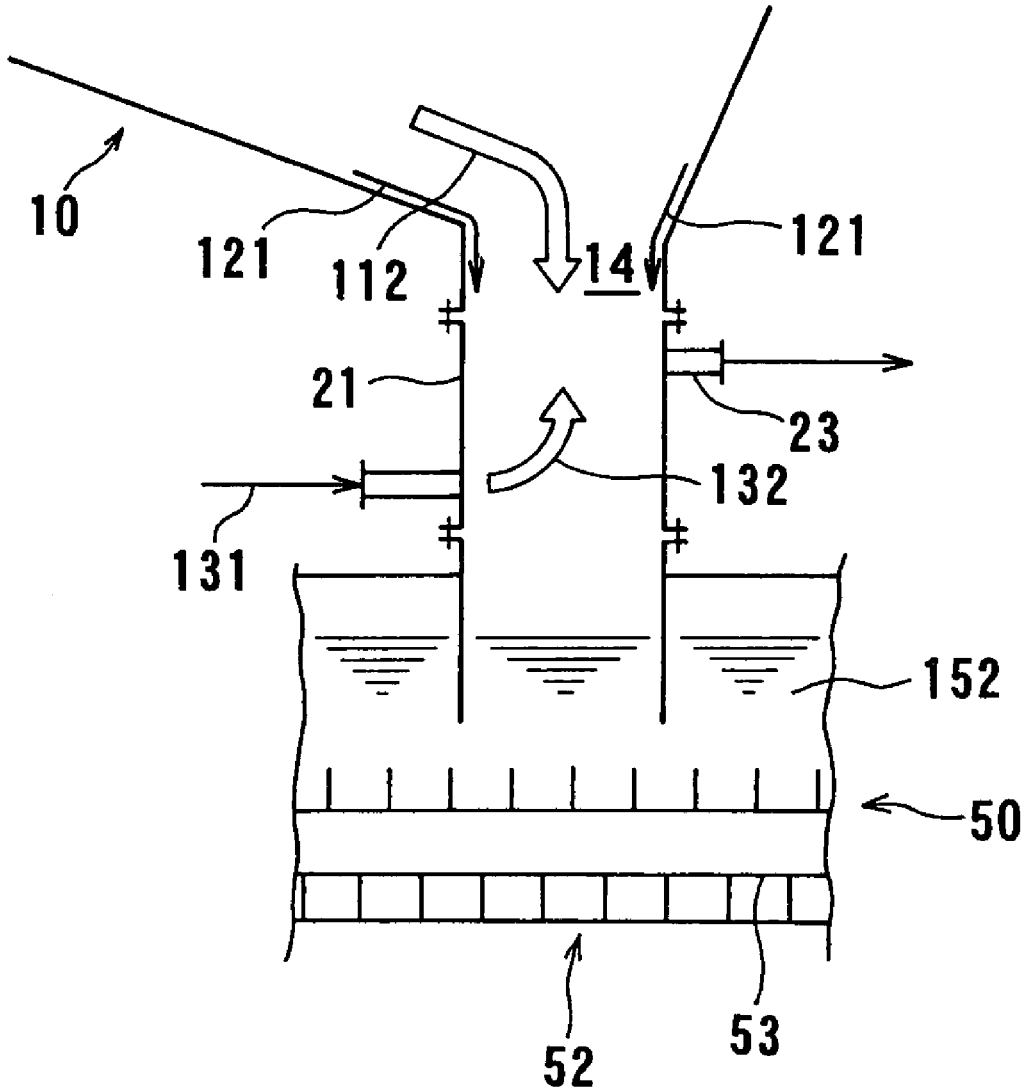
FIG. 6 is a schematic view showing a slag discharge port and a portion around the slag discharge port in a slagging combustion furnace according to the present invention.

In the embodiment shown in FIGS. 2 and 4, the molten slag 121 discharged from the slag discharge port 14 is discharged through the water quenching trough 30 into the slag separating apparatus 50. However, the water quenching trough 30 may not necessarily be required. For example, as shown in FIGS. 5 and 6, molten slag 121 discharged from the slag discharge port 14 is directly discharged into the slag cooling water 152 in the slag separating apparatus 50. The air or inert gas 132 blown from the gas blowing line 131 is introduced between the slag discharge port 14 and the water surface of the slag cooling water 152.

In the above embodiments, the slagging combustion furnace comprises a swirling-type slagging combustion furnace. However, the present invention is not limited to a swirling-type slagging combustion furnace, but is applicable to a melting furnace apparatus having a melting furnace for melting ash into molten slag, such as a plasma melting furnace, a surface melting furnace, or the like.

A gasifying apparatus in the gasification and slagging combustion system according to the present invention has a gasification furnace for gasifying combustibles such as wastes, although such gasification furnace is not shown. The gasification furnace may comprise any desired gasification furnace such as an internal circulating fluidized-bed gasification furnace, an external circulating fluidized-bed gasification furnace, or a kiln furnace. In the fluidized-bed gasification furnace, a fluidized medium such as sand, Olivin sand, or alumina is used, and a fluidizing gas such as preheated air, air, oxygen-enriched air, or steam is introduced from an air diffuser plate or air diffuser pipes to form a circulating flow of the fluidized medium in a fluidized bed. The circulating flow of the fluidized medium may be oriented in any direction and is expected to provide an effect to transfer heat in the fluidized bed and an effect to crush materials such as wastes to be treated. The direction of the circulating flow of the fluidized medium may be designed depending on the position where incombustibles are withdrawn from the furnace. Various materials including wastes are supplied to the fluidized bed from the location above the fluidized bed in which the circulating flow of the fluidized medium is formed, and pyrolyzed and gasified in the fluidized bed. The gas, which accompanies ash and pulverized carbon, produced in the fluidized-bed gasification furnace is then introduced into the subsequent slagging combustion furnace (melting furnace) of the gasification and slagging combustion system according to the present invention.

As described above, according to the present invention, the following excellent effects can be obtained.

(1) The gas blowing means is provided to blow air or inert gas between the slag discharge port of the slagging combustion furnace and the surface of the slag cooling water, thus preventing exhaust gas from contacting the slag cooling water. Therefore, the slag cooling water is prevented from being lowered in quality. The water-quenched slag is prevented from being lowered in quality due to a reduced quality of the slag cooling water, i.e., the water-quenched slag is prevented from being lowered in quality due to contamination of the slag cooling water. Further, the slag discharge port and the portion around the slag discharge port is prevented from being cooled due to steam generated by evaporation of the slag cooling water.

(2) The gas mixture line (the gas mixture drawing/blowing line) is provided to draw a mixed gas from the slag discharge portion of the slagging combustion furnace and to blow the mixed gas into the slagging combustion furnace. The gas mixture line draws the air or inert gas blown to the slag discharge portion and also steam produced by evaporation of the slag cooling water, thus preventing the slag discharge port and the portion around the slag discharge port from being cooled. The gas mixture line also draws the exhaust gas having a high temperature through the slag discharge port, thus keeping the slag discharge port and the portion around the slag discharge port at a high temperature with the high-temperature exhaust gas and maintaining dischargeability of the slag. The air that has been blown in is supplied through the gas mixture line into the slagging combustion furnace, particularly a tertiary combustion chamber of the slagging combustion furnace, and can be utilized as combustion air.

(3) By providing the flow control means, the flow rate of the gas mixture drawn from the slag discharge portion can be controlled.

(4) By providing the temperature sensor in the gas mixture line, the flow control means controls the flow rate of the gas mixture so as to keep the temperature of the gas mixture line at the set temperature based on the output from the temperature sensor. If the set temperature is set to a value equal to or lower than the allowable temperature of the fan provided in the gas mixture line, then the temperature of the gas mixture line can be kept to be equal to or lower than the allowable temperature of the fan. If the gas mixture line is operated at a temperature of the dew point of hydrogen chloride contained in the exhaust gas or higher, low-temperature corrosion of ducts which define the gas mixture line and the suction fan connected thereto is prevented.

(5) Harmful impurities such as heavy metals attached to the surfaces of the water-quenched slag can be removed from the water-quenched slag by the cleaning water supplied from the cleaning water supply system, and hence the water-quenched slag of good quality can be recovered.

Furthermore, even if the exhaust gas discharged together with the molten slag from the slagging combustion furnace is not completely prevented from contacting the slag cooling water, the same cleaning effect can be obtained.

(6) When the air or inert gas is blown between the slag discharge port of the slagging combustion furnace and the surface of the slag cooling water, the exhaust gas is prevented from contacting the slag cooling water, and hence the slag cooling water is prevented from being lowered in quality. The water-quenched slag is thus prevented from being lowered in quality due to a reduced quality of the slag cooling water.

(7) After the water-quenched slag is scraped and removed from the bottom of the water tank and is conveyed above the surface of the slag cooling water in the water tank, the water-quenched slag is cleaned by the cleaning water sprayed from the cleaning water supply system. Consequently, harmful impurities such as heavy metals attached to the surfaces of the water-quenched slag can be removed from the water-quenched slag, and hence the water-quenched slag of good quality can be recovered.

(8) The gas blowing means is provided to blow the air or inert gas between the slag discharge port of the slagging combustion furnace and the surface of the slag cooling water, thus preventing exhaust gas discharged from the slagging combustion furnace through the slag discharge port from contacting the slag cooling water. Therefore, the gasification and slagging combustion system can be constructed such that the slag cooling water is prevented from being lowered in quality. The water-quenched slag is also prevented from being lowered in quality due to a reduced quality of the slag cooling water.

(9) After the water-quenched slag is scraped and removed from the bottom of the water tank and is conveyed above the surface of the slag cooling water, the cleaning water supplied from the cleaning water supply system is sprayed over the water-quenched slag to remove harmful impurities such as heavy metals attached to the surfaces of the water-quenched slag. Therefore, the gasification and slagging combustion system which can recover the water-quenched slag of good quality can be constructed.

INDUSTRIAL APPLICABILITY

The present invention is applicable to a melting system for bringing molten slag discharged from an ash melting furnace into contact with water to produce water-quenched slag and a method of operating such melting system, and a melting system attached to a gasification and slagging combustion system for combusting and treating various wastes including municipal wastes, refuse-derived fuel (RDF), plastic wastes, waste FRP, biomass wastes, automobile wastes, waste oil, and the like.

The invention claimed is:

1. An ash melting system comprising:

a slagging combustion furnace for melting ash into molten slag and discharging the molten slag from a slag discharge port;

a slag separating apparatus for bringing the molten slag into contact with slag cooling water to produce water-quenched slag, and for separating the water-quenched slag from the slag cooling water; and a gas blowing member for blowing air or inert gas between said slag discharge port of said slagging combustion furnace and the surface of the slag cooling water.

2. A system according to claim 1, further comprising:

a gas mixture line for drawing a gas mixture of exhaust gas discharged from said slag discharge port of said slagging combustion furnace and the air or inert gas blown from said gas blowing member, and for supplying said gas mixture into said slagging combustion furnace.

3. A system according to claim 2, further comprising:

a flow control member provided in said gas mixture line for controlling the flow rate of said gas mixture drawn by said gas mixture line.

4. A system according to claim 3, further comprising:

a temperature sensor provided in said gas mixture line for measuring the temperature of said gas mixture in said gas mixture line;

wherein said flow control member is operated based on an output of said temperature sensor to control the flow rate of said gas mixture drawn by said gas mixture line to equalize the temperature of said gas mixture line with a set temperature.

5. The ash melting system of claim 1, wherein said gas blowing member includes a gas inlet port located below said slag discharge port and above the surface of the slag cooling water.

6. The ash melting system of claim 1, wherein said gas blowing member is arranged so as to introduce the air or inert gas to create a gas barrier between exhaust gas in said slagging combustion furnace and the surface of the slag cooling water.

7. The ash melting system of claim 1, wherein said gas blowing member is arranged to blow the air or inert gas in a direction from the surface of the slag cooling water toward said slag discharge port.

8. A method of operating an ash melting system for producing water-quenched slag from molten slag discharged from a slagging combustion furnace, and for then separating the water-quenched slag from slag cooling water, the method comprising:

blowing air or inert gas between a slag discharge port of the slagging combustion furnace and the surface of the slag cooling water.

9. The method of operating an ash melting system of claim 8, wherein said blowing comprises blowing the air or inert gas in a direction from the surface of the slag cooling water toward the slag discharge port.

10. The method of operating an ash melting system of claim 8, wherein said blowing the air or inert gas comprises introducing the air or inert gas to create a gas barrier between exhaust gas in the slagging combustion furnace and the surface of the slag cooling water.

11. A gasification and slagging combustion system comprising:

a gasification furnace for gasifying wastes to generate gasification products;

a slagging combustion furnace for combusting said gasification products to produce molten slag; and a gas blowing member for blowing air or inert gas between a slag discharge port of said slagging combustion furnace and the surface of slag cooling water.

12. The gasification and slagging combustion system of claim 11, wherein said gas blowing member includes a gas inlet port located below said slag discharge port and above the surface of the slag cooling water.

13. The gasification and slagging combustion system of claim 11, wherein said gas blowing member is arranged so as to introduce the air or inert gas to create a gas barrier between exhaust gas in said slagging combustion furnace and the surface of the slag cooling water.

14. The gasification and slagging combustion system of claim 11, wherein said gas blowing member is arranged to blow the air or inert gas in a direction from the surface of the slag cooling water toward said slag discharge port.

* * * * *

UNITED STATES PATENT AND TRADEMARK OFFICE

CERTIFICATE OF CORRECTION

PATENT NO. : 7,040,240 B2
APPLICATION NO. : 10/485272
DATED : May 9, 2006
INVENTOR(S) : Chikao Goke et al.

It is certified that error appears in the above-identified patent and that said Letters Patent is hereby corrected as shown below:

On The Title Page, Col. 1

In item (54):

Please replace the title with --ASH MELTING SYSTEM AND WASTES GASIFICATION AND SLAGGING COMBUSTION SYSTEM AND METHOD OF OPERATING SUCH MELTING SYSTEM--.

Signed and Sealed this

Twenty-second Day of August, 2006

JON W. DUDAS
*Director of the United States Patent and Trademark Office*